United States Patent [19]

Anzalone

[11] 4,287,858

[45] Sep. 8, 1981

[54] INTERNAL COMBUSTION ENGINE

[75] Inventor: Luigi Anzalone, Rochester, N.Y.

[73] Assignee: Vincenzo Pasquarella, Rochester, N.Y.

[21] Appl. No.: 66,072

[22] Filed: Sep. 21, 1979

[51] Int. Cl.[3] ..... F02B 57/00

[52] U.S. Cl. ..... 123/43 AA

[58] Field of Search ..... 123/43 A, 43 AA; 91/499, 501

[56] References Cited

U.S. PATENT DOCUMENTS

| | | | |
|---|---|---|---|
| 1,569,525 | 1/1926 | Owens | 123/43 AA |
| 1,614,476 | 1/1927 | Hutchinson | 123/43 AA |
| 4,022,167 | 5/1977 | Kristiansen | 123/43 AA |

FOREIGN PATENT DOCUMENTS

| | | | |
|---|---|---|---|
| 734288 | 6/1932 | France | 123/43 AA |

*Primary Examiner*—Michael Koczo, Jr.

*Attorney, Agent, or Firm*—Shlesinger, Fitzsimmons & Shlesinger

[57] ABSTRACT

Two piston plates are mounted for rotation and axial reciprocation in the bore of a cylindrical housing, and at right angles to each other. Each plate carries on opposite ends thereof a pair of pistons which reciprocate in spaced bores formed in a pair of rotary cylinder plates located in opposite ends of the housing. Each cylinder plate has an integral shaft projecting therefrom to the exterior of the housing. A plurality of roller cam followers project from opposite sides of the piston plates into a sinusoidally shaped cam track formed in the bore of the housing, so that when fuel is fed into the piston bores and properly ignited, the reciprocation imparted to the piston plates causes the cam followers to roll in the undulating cam track to impart rotation to the cylinder plates and to the shafts which project therefrom.

9 Claims, 4 Drawing Figures

INTERNAL COMBUSTION ENGINE

This invention relates to engines, and more particularly, to a novel engine of the internal combustion variety. More particularly this engine relates to a rotary-type internal combustion engine.

Most IC (internal combustion) engines in use today are found in the automotive field, and are of the reciprocatory variety in which pistons reciprocate in cylinders radially of a drive shaft to which the pistons are connected by means of crank mechanisms. The reciprocatory movements of the pistons are therefore converted into rotary motion (the drive shaft rotation) by the agency of the crank mechanisms.

It is an object of this invention to provide an improved IC engine which utilizes combination reciprocable and rotary pistons for imparting rotary motion to a drive shaft.

Another object of this invention is to provide an improved IC engine of the type in which reciprocable pistons are connected by roller cams to undulating cam tracks which cause the reciprocable motion of the pistons to be translated into rotary motion.

Further object of this invention is to provide an IC engine of the type described which is substantially more compact and efficient than prior IC engines, and is relatively inexpensive to manufacture.

Still another object of this invention is to provide an engine of the type described in which the drive pistons reciprocate in directions parallel to the axis of rotation of the shaft which is driven by the pistons.

Other objects of the invention will be apparent hereinafter from the specification and from the recital of the appended claims, particularly when read in conjunction with the accompanying drawing.

Figure 1:
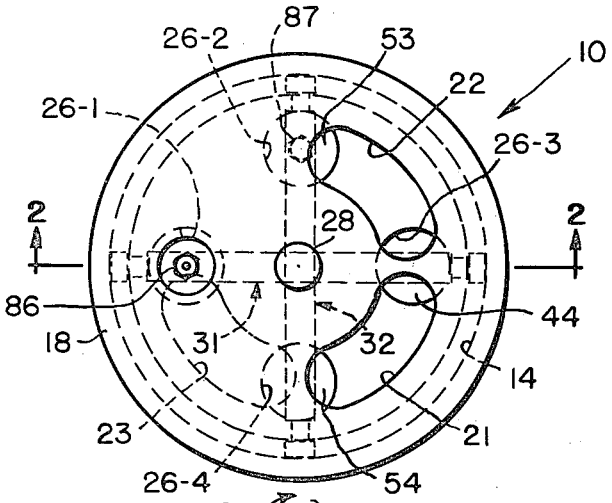
FIG. 1 is a plan view of a rotary IC engine made according to one embodiment of this invention, but with the fuel supply and exhaust ducts removed better to illustrate one of the fuel plates which form part of the engine.
Figure 4:
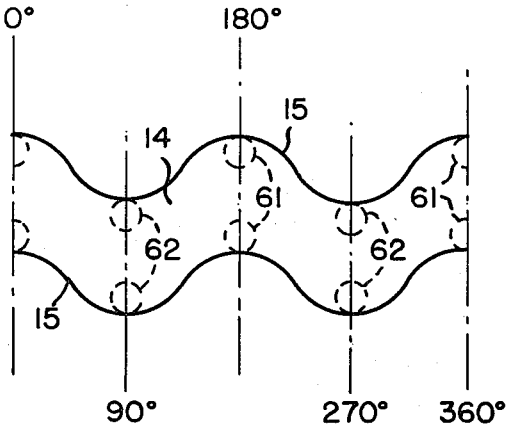
FIG. 4 is an exploded view of the cam track which is formed in the inner peripheral surface of the cylindrical housing for this engine.

Referring now to the drawing by numerals of reference, 10 denotes generally an engine comprising a tubular housing 12 having in its inner peripheral surface, and medially of its ends, an undulating, endless cam path or recess 14, opposed edges of which are of generally sine wave configuration as denoted at 15 in FIG. 4. Secured to opposite ends of housing 12 coaxially thereof are two fuel supply plates 18 and 19. At one diametral side thereof (the right side as illustrated in FIG. 1) plate 18 has therethrough a pair of spaced, arcuate ports 21 and 22 for conveying fuel to, and for removing exhaust gases from, one end of the engine as noted hereinafter. Similarly, the plate 19 at the opposite end of the engine housing also has therein a pair of spaced, arcuate ports 23 and 24 which serve to supply fuel to, and to exhaust gases from, the opposite end of the housing as noted hereinafter. Note that port 21 registers axially with port 24, and ports 21 and 23 are angularly spaced 180° from each other about the axis of the housing.

Figure 2:
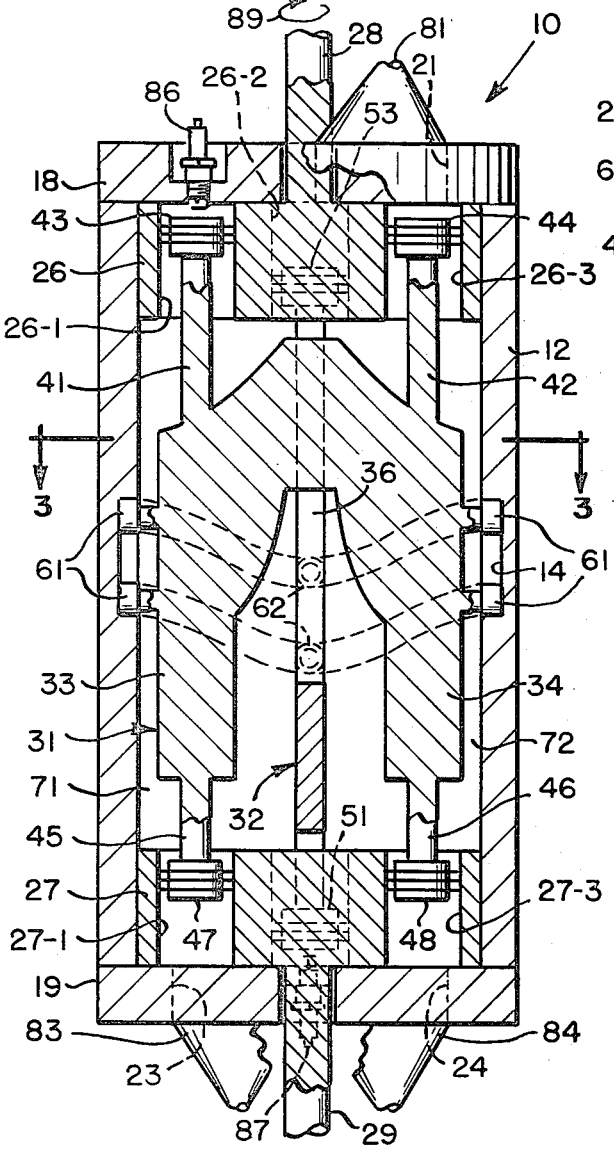
FIG. 2 is a fragmentary sectional view taken along the line 2—2 in FIG. 1 looking in the direction of the arrows, but with parts thereof shown in full.

Mounted to rotate in opposite ends of housing 12 coaxially thereof, and adjacent to the inside surfaces of the plates 18 and 19, respectively, are two, axially-spaced disc-shaped cylinder plates 26 and 27. Each of these plates has therethrough four, identical, axially extending bores which are equi-angularly spaced about the axial centerline of the plate and housing 12. In the plate 26 these bores are denoted at 26-1, 26-2, 26-3 and 26-4, and in plate 27 are denoted at 27-1, 27-2, 27-3 and 27-4, respectively. A shaft 28 is integral at one end coaxially with the outer surface of the plate 26, (the upper surface as illustrated in FIG. 1) and projects outwardly and rotatably through a registering bore formed in the center of the fuel plate 18. A similar shaft 29 is integral at its inner or upper end as shown in FIG. 2 with the outer or lower surface of the rotatable plate 27 coaxially thereof, and projects downwardly and outwardly through a registering bore in the center of the fuel plate 19.

Mounted for reciprocable and rotational movements in housing 12 are two piston plates which are denoted generally by the numerals 31 and 32, respectively. These two plates are similar in appearance, each being generally U-shaped or yoke-shaped in configuration. However, they are mounted in the bore of housing 12 to face in opposite directions, and to lie in diametral planes which intersect each other at right angles. For example, the plate 31 is located in an inverted position in housing 12, in the sense that its two, spaced, parallel leg portions 33 and 34 project downwardly in the housing to be then disposed in spaced, overlapping relation to the closed end of the U-shaped plate 32; while the two leg portions 35 and 36 of the plate 32, on the other hand, project upwardly in housing 12 in spaced overlapping relation to the closed end of the inverted plate 31. The space between the leg portions 33 and 34 of plate 31 thus register with the space between the leg portions 35 and 36 of plate 32, so that these two plates do not interfere with the reciprocation of each other axially in housing 12.

On its upper end plate 31 has a pair of spaced, parallel projections 41 and 42, which carry pistons 43 and 44 that reciprocate in the bores 26-1 and 26-3, respectively, of plate 26. At their lower ends the leg portions 33 and 34 of the plate 31 have similar projections 45 and 46 which carry pistons 47 and 48 that reciprocate in the bores 27-1 and 27-3 in plate 27.

In a similar manner, pistons 51 and 52 are carried by projections on the lower end of the U-shaped plate 32 to reciprocate in the bores 27-2 and 27-4 respectively, of plate 27, while pistons 53 and 54 are carried by projections on the upper ends of the leg portions 36 and 35, respectively, of plate 32, to reciprocate in the bores 26-2 and 26-4, respectively, of plate 26.

On its outer edge, each leg portion 33 and 34 of the plate 31 carries a pair of vertically spaced roller cam followers 61, which project into the cam race 14 in housing 12 to have rolling engagement about parallel axes with the upper and lower surfaces, respectively, of the race. Similarly, each of the leg portions 35 and 36 of plate 32 carries on its outer edge a pair of vertically spaced cam followers or rollers 62, which rotate about parallel axes and in rolling engagement with the upper and lower surfaces 15 of the undulating cam race 14.

For proper operation of the engine is necessary that the plates 31 and 32 be maintained at right angles to each other at all times. This is effected by the use of four, angularly spaced, segmental cylindrical members 71, 72, 73 and 74, which are mounted in the bore of housing 12 to extend between the inner, confronting surfaces of the rotatable cylinder plates 26 and 27, and which are designed to fill the four spaces or quadrants formed within the bore of housing by the intersecting planes in which the plates 31 and 32 lie. As shown more clearly in FIG. 3, each member 71–74 has an outer, arcuate surface which conforms to the inner peripheral surface of the housing 12, and is generally pie-shaped in cross section so that each of its radial surfaces has coplanar engagement with one of the plane side surfaces of each plate 31 and 32. Consequently, any rotation imparted to the plates 31 and 32 is imparted also to the members 71–74. These members therefore function both as inertia members and as a means to maintain plates 31 and 32 in right-angular relationship to each other.

In use, fuel from a supply thereof is fed from a carburetor through a duct 81 (FIG. 2) to the port 21 in plate 18. A similar duct (not illustrated) connects the exhaust port 22 in the plate 18 with the exhaust plenum (not illustrated) of the engine. Similarly, the fuel supply is connected through another duct 83 with the port 23 in plate 19, while the other port 24 in this plate is connected by a duct 84 with the exhaust system. Spark plugs 86 and 87 are secured in openings in plates 18 and 19, respectively, to ignite fuel compressed in the piston bores of these respective plates as noted hereinafter.

Figure 3:
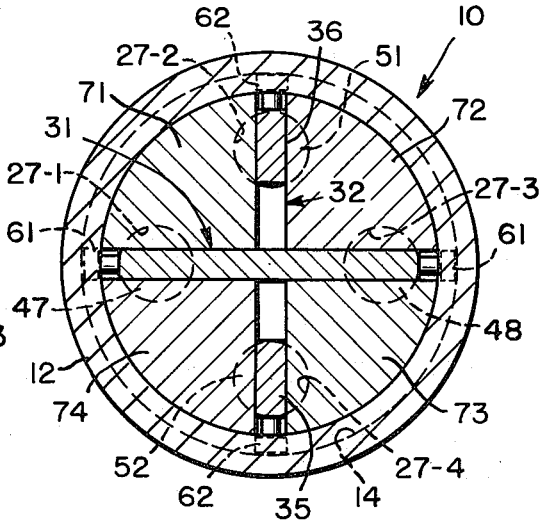
FIG. 3 is a sectional view taken along the line 3—3 in FIG. 2 looking in the direction of the arrows.

Assuming that the parts are in the positions illustrated in the drawing, and that the plates 31 and 32 are rotating clockwise in FIG. 3, or in the direction of the arrow 89 in FIG. 2, when fuel is supplied to the ports 21 and 23 it is drawn into the piston bores 27-4 and 26-3 as the pistons 52 and 44 are drawn downwardly in these bores as the plates rotate 90° clockwise (FIG. 3) from the positions shown in the drawings. At the same time, the plugs 86 and 87 will have ignited fuel previously compressed in the piston bores 26-1 and 27-2, which now register with the respective plugs as shown in the drawing, so that at this time the expanding gases in these bores will be driving pistons 51 and 43 inwardly or downwardly in their bores 26-1 and 27-2.

Also during this 90° rotation of plates 31 and 32 pistons 53 and 48 will be moving outwardly in their respective bores 26-2 and 27-3 to force previously burned fuel out of the ports 22 and 24, respectively, while at the same time the companion, outwardly moving pistons 54 and 47 will be compressing fuel in their bores 26-4 and 27-1 which are now closed at their outer ends by plane surfaces on the plates 18 and 19, respectively. At the end of this 90° rotation of plates 31 and 32 the compressed fuel in these bores 26-4 and 27-1 will pass into communication with the sparking ends of plugs 86 and 87, respectively, so that pistons 54 and 47 will then be driven downwardly in their bores.

From the foregoing it will be apparent that ignition occurs at each end of the engine for every 90° of rotation of plates 31 and 32, and each such occurrence causes the cam means 14, 61 to impart rotation to members 31 and 32. For example, above-noted ignition which drives pistons 51 and 43 inwardly of their bores also causes the roller followers 61 to be driven downwardly in the cam track 14 (from the zero degree to 90 degree positions and from the 180 degree to 270 degree positions as shown in FIG. 4) while at the same time the roller followers 62 are caused to ride upwardly in the cam slot 14 (from their broken line positions as shown in FIG. 4 to the 180 degree and 360 degree positions, respectively). The roller followers thus cause the plates 31, 32 and inertia members 71 to 74 to rotate about the axis of the cylinder 12 in response to the reciprocable movement that is imparted to the pistons by the burning fuel.

By properly timing the igniting of fuel in the respective piston bores as they pass successively into registry with the plug 86 or 87, continuous rotation can be imparted by the plates 31 and 32 to the piston plates 26 and 27. These plates in turn impart rotation to the integral shaft portions 28 and 29, which can then be used as driving shafts.

With an engine of the type described it is possible to eliminate any special valving system for controlling the admission of fuel to, or the exhaust of gases from, the piston bores, because this operation is performed by proper porting between the stationary fuel supply plates 18 and 19, and the associated cylinder plates 26 and 27 which rotate relative to plates 18 and 19. Obviously bearings and seals will have to be utilized to enable the cylinder plates to rotate with proper sealing surfaces against the confronting surfaces of plates 18 and 19, but these features are believed to be within the scope of one skilled in the art, and are thereby not set forth in detail herein.

It will be appreciated also that this invention is capable of still further modification, and that this application is intended to cover any such modifications that may fall within the scope of ones skilled in the art or the appended claims.

What I claim is:

1. An engine, comprising a housing having a cylindrical bore, a pair of axially-spaced, circular cylinder plates mounted to rotate in opposite ends of said housing bore coaxially thereof, each of said cylinder plates having therein at least one axially-extending piston bore opening at its inner end on said housing bore, at least one piston member extending transversely across the center of said housing bore in the axial space between said cylinder plates, and mounted for axial reciprocation in said bore and for rotation with said plates, at least one piston carried on each end of said member for reciprocation in the piston bore in the adjacent cylinder plate, means for conveying combustible fuel to, and for conveying exhaust gases from, the outer ends of said piston bores, whereby cyclical combustion of said fuel in said piston bores imparts reciprocation to said piston member, means interposed between said housing and said member and operative to impart rotation to said member and said plates during reciprocation of said member in said housing, and a shaft connected to at least one of said plates for rotation therewith in axially spaced relation to said piston member, and projecting from said one plate to the exterior of said housing coaxially thereof.

2. An engine as defined in claim 1, wherein said piston member has thereon opposed, peripheral surfaces confronting the peripheral surface of the housing bore, and the last-named means comprises a sinusoidal cam track formed in one of the confronting peripheral surfaces on said member and on said housing bore, respectively, and a plurality of roller followers projecting from the other of said confronting surfaces to have rolling engagement in said cam tracks.

3. An engine, comprising a housing having a cylindrical bore, a pair of axially-spaced, circular cylinder plates mounted to rotate in opposite ends of said housing bore coaxially thereof, each of said cylinder plates having therein at least one axially-extending piston bore opening at its inner end on said housing bore, at least one piston member mounted for reciprocation in said housing bore in the axial space between said cylinder plates, and for rotation with said plates, at least one piston carried on each end of said member for reciprocation in the piston bore in the adjacent cylinder plate, means for conveying combustible fuel to, and for conveying exhaust gases from, the outer ends of said piston bores, whereby cyclical combustion of said fuel in said piston bores imparts reciprocation to said piston member, means interposed between said housing and said member and operative to impart rotation to said member and said plates during reciprocation of said member in said housing, and a shaft projecting from at least one of said plates to the exterior of said housing coaxially thereof, said means for imparting rotation to said member comprising a sinusoidal cam track formed in one of the confronting peripheral surfaces on said member and on said housing bore, respectively, a plurality of roller followers projecting from the other of said confronting surfaces to have rolling engagement in said cam tracks, two of said piston members being mounted in said housing bore for rotation in unison with said cylinder plates, and being flat plates reciprocable relative to each other in intersecting diametral planes which extend at right angles to each other in said housing bore, and each of said members carrying on each end thereof a pair of pistons which reciprocate in one of two pairs of piston bores which are formed in each of said cylinder plates.

4. An engine as defined in claim 3, including four axially-extending, segmental-cylindrical spacer members, each of which is mounted in said housing bore in one of the four quadrants formed by the intersecting piston members, and each of which has an arcuate surface complimentary to the bore wall in said housing, and a pair of intersecting, plane surfaces engaging one side surface of each of said piston members to maintain the latter at right angles to each other.

5. An engine as defined in claim 3, wherein said two piston members are generally U-shaped in configuration and have the parallel leg portions thereof facing opposite ends, respectively, of said cylinder bore to prevent interference of one of said members with the other during reciprocation of said members.

6. An internal combustion engine, comprising a housing having an axial bore, and a pair of rotatable, axially spaced shafts mounted to rotate adjacent their inner ends in opposite ends, respectively, of said housing, and projecting at their outer ends exteriorly of said housing coaxially of said bore, a pair of axially-spaced piston cylinders rotatably mounted in said bore in said housing adjacent opposite ends thereof and secured each to the inner end of a different one of said shafts for rotation therewith, a plurality of piston members mounted in said bore in the axial space between said piston cylinders for rotation coaxially of the axis of said housing, and for reciprocation relative to each other in directions parallel to the axis of said housing, at least one piston mounted on each end of each of said piston members and being reciprocable in one of a plurality of piston bores formed in the adjacent piston cylinder, means for supplying combustible fuel to and to convey exhaust gases from said piston bores in said piston cylinders, thereby to impart reciprocation to said piston members upon proper firing of the combustible fuel in said piston bores, and cam means interposed between said piston cylinders and said housing and operative to cause the reciprocable movement of said piston members to effect rotation of said members, and consequently to effect also rotation of said piston cylinders and the shafts secured thereto, said cam means comprising an undulating cam race formed in the bore wall of said housing and surrounding said piston members, and a pair of rotatable cam followers mounted on opposite sides, respectively, of each of said piston members and having rolling engagement with said cam race.

7. An internal combustion engine as defined in claim 6, wherein said means for supplying fuel to and conveying gases from said piston bores, comprises a pair of fuel supply plates secured to opposite ends, respectively, of said housing and having thereon plane surfaces disposed in confronting relation to plane surfaces on said rotatable piston cylinders, each of said supply plates having therethrough at least a pair of angularly spaced ports disposed to register selectively with the piston bores in the adjacent cylinder plate, and means for connecting one of said pair of ports in each supply plate with a supply of fuel, and for connecting the other port of said pair with an exhaust plenum.

8. An internal combustion engine, comprising a housing having an axial bore, and a pair of rotatable shafts projecting from opposite ends, respectively, of said housing coaxially of said bore, a pair of axially-spaced piston cylinders rotatably mounted in said bore adjacent opposite ends thereof and secured each to a different one of said shafts for rotation therewith, a plurality of piston members mounted in said bore between said piston cylinders for rotation coaxially of the axis of said housing, and for reciprocation relative to each other in directions parallel to the axis of said housing, at least one piston mounted on each end of each of said piston members and being reciprocable in one of a plurality of piston bores formed in the adjacent piston cylinder, means for supplying combustible fuel to and to convey exhaust gases from said piston bores in said piston cylinders, thereby to impart reciprocation to said piston members upon proper firing of the combustible fuel in said piston bores, and cam means interposed between said piston cylinders and said housing and operative to cause the reciprocable movement of said piston members to effect rotation of said members, and consequently to effect also rotation of said piston cylinders and the shafts secured thereto, said piston members comprising a plurality of rigid plates mounted in intersecting planes extending diametrally of the bore in said housing, and equi-angularly spaced about the axis of the housing bore, and a plurality of spacer members mounted for rotation in said housing bore in the angular spaces formed between said rigid plates, and operative to retain said plates in equi-angular relation about said axis of the housing bore.

9. An internal combustion engine as defined in claim 8, wherein there are two of said piston members mounted in said housing bore for rotation about the axis of said housing bore in diametral planes which intersect at right angles along the last-named axis.

* * * * *